United States Patent [19]

Pratt

[11] Patent Number: 4,674,211

[45] Date of Patent: Jun. 23, 1987

[54] FRAME STRUCTURE

[75] Inventor: Sherwood L. Pratt, Brookline, Mass.

[73] Assignee: The Architectural Glass Company, Inc., Boston, Mass.

[21] Appl. No.: 792,488

[22] Filed: Oct. 29, 1985

[51] Int. Cl.[4] ..... G09F 13/04

[52] U.S. Cl. ..... 40/564; 40/563; 40/574; 40/152.2

[58] Field of Search ..... 40/563, 564, 580, 578, 40/574, 152.2, 152

[56] References Cited

U.S. PATENT DOCUMENTS

| | | | |
|---|---|---|---|
| 673,647 | 5/1901 | Meacham | 40/563 |
| 1,696,878 | 12/1928 | Bliss | 40/563 |
| 1,746,943 | 2/1930 | Hofmann | 40/574 |
| 1,761,868 | 6/1930 | Burke | 40/574 |
| 1,827,963 | 10/1931 | Wompey | 40/563 |
| 1,931,448 | 10/1933 | Noble | 40/563 |
| 2,170,377 | 8/1939 | Nisle | 40/152.2 |
| 2,487,403 | 11/1949 | Wisdom | 40/152.2 |
| 2,577,982 | 12/1951 | Traum | 40/152.2 |
| 2,588,545 | 3/1952 | Lawrence | 40/152.2 |
| 2,677,909 | 5/1954 | Heydenryk | 40/152.2 |
| 2,766,540 | 10/1956 | Brown et al. | 40/574 |
| 3,324,290 | 6/1967 | Lasker | 40/563 |
| 3,742,203 | 6/1973 | Noe | 40/152.2 |

FOREIGN PATENT DOCUMENTS

| | | | |
|---|---|---|---|
| 746893 | 7/1933 | France | 40/564 |
| 953206 | 1/1949 | France . | |
| 1074125 | 10/1954 | France | 40/574 |
| 2345971 | 1/1975 | France . | |
| 284224 | 7/1952 | Switzerland | 40/574 |
| 239410 | 9/1925 | United Kingdom | 40/564 |

*Primary Examiner*—Robert P. Swiatek
*Assistant Examiner*—J. Hakomaki

[57] ABSTRACT

Frame structure for support and display of a stained glass work of art or the like that includes a metal structural frame assembly; an opaque reflector panel secured to the rear of the structural metal frame assembly; a perimeter assembly secured to the metal frame assembly that defines a sight area for the planar, light-transmitting work of art and a series of compartments that extend about the periphery of the metal frame assembly, together with a work of art support within the sight area, and a diffuser panel secured to the perimeter assembly and extending beneath the sight area between the work of art and the reflector panel. Disposed in the series of compartments and located rearwardly of the diffuser panel are a plurality of light sources. Light from the light sources passes through the metal frame assembly and through the diffuser panel and the work of art. A control for varying the level of radiation from the radiation sources is preferably mounted on the perimeter assembly, and a series of opaque access panels and movable between closed and open positions to provide access to the light sources.

14 Claims, 4 Drawing Figures

FRAME STRUCTURE

This invention relates to frame structures for mounting works of art and more particularly to a frame structure for displaying light transmitting works of art in sheet form such as stained glass and the like.

Sheet form light transmitting works of art such as a stained glass assembly are typically displayed in windows, for example, of churches, where viewing of the work of art is enhanced by the transmission of light through the stained glass assembly. Such works of art typically are relatively heavy, massive and fragile, and therefore require a sturdy support for display which conventionally is built into the exterior wall of the building where the work of art is to be mounted.

In accordance with the invention, there is provided frame structure for support and display of a stained glass work of art or the like that includes a metal structural frame assembly; an opaque reflector panel secured to the rear of the structural metal frame assembly; a first perimeter assembly secured to the forward portion of the metal frame assembly that defines a sight area for the planar, light-transmitting work of art, together with means for securing the work of art within the sight area and a diffuser panel secured to the first perimeter assembly and extending beneath the sight area between the work of art and the reflector panel; and a second perimeter assembly disposed outwardly and rearwardly of the first perimeter assembly such that a series of compartments that extend about the periphery of the metal frame assembly are defined between the first and second perimeter assemblies. Disposed in the series of compartments and located rearwardly of the diffuser panel are a plurality of radiation sources such that radiation from the radiation sources passes through the metal frame assembly for reflection by the reflector panel and through the diffuser panel and the work of art. Control means for varying the level of radiation from the radiation sources is preferrably mounted on one of the perimeter assemblies, and a series of opaque access panels extend between the first and second perimeter assemblies, each panel being movable between a closed position and an open position in which access to a radiation source is enabled.

In a particular embodiment, the frame is of rectangular configuration, an elongated radiation source compartment extends along each side of the rectangular frame, and each access panel is of trapezoidal configuration and extends along the length of a side of the rectangular frame. The metal structural frame assembly includes a plurality of angle members disposed in spaced apart relation to define substantially open compartment walls adjacent the space between planar diffuser and reflector panels that are spaced apart and generally parallel to one another, each perimeter assembly is of wood material with the control means including a plurality of electrical switch control elements that are disposed in the second perimeter frame assembly and connected to elongated fluorescent lamp radiation sources.

Other features and advantages of the invention will be seen as the following description of a particular embodiment progresses, in conjunction with the drawing, in which.

DESCRIPTION OF PARTICULAR EMBODIMENT

Figure 1:
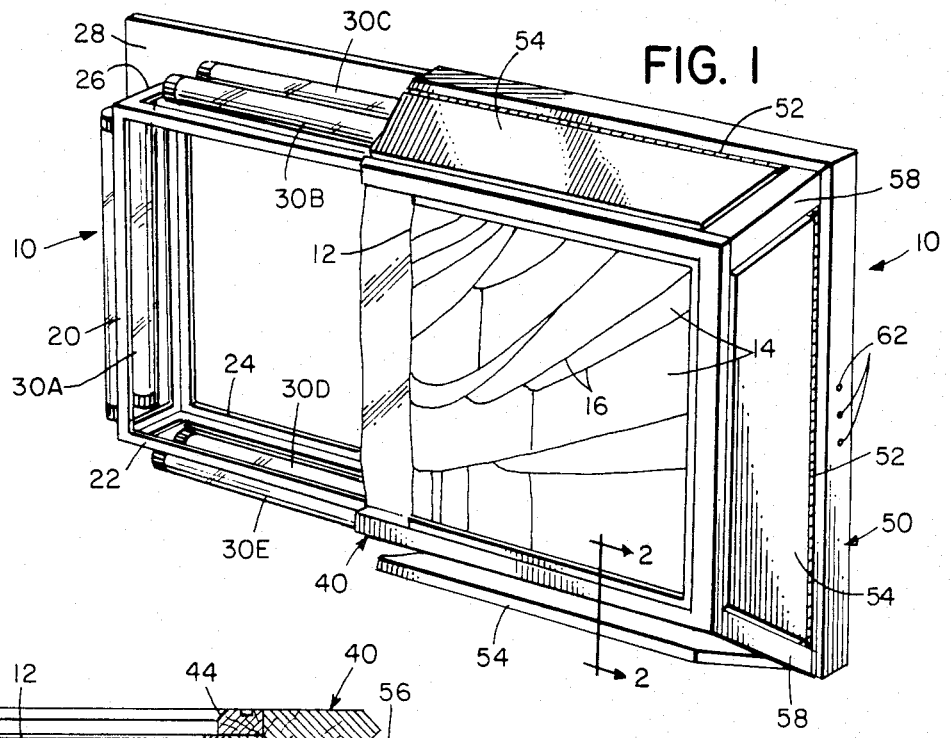
FIG. 1 is a perspective view, with portions broken away, of a display frame for a stained glass work of art in accordance with the invention.

The display frame 10 shown in FIG. 1 supports a stained glass work of art 12 which typically has a weight of about ten pounds per square foot and includes planar, light-transmitting stained glass elements 14 that are secured to one another with lead strips 16.

Figure 2:
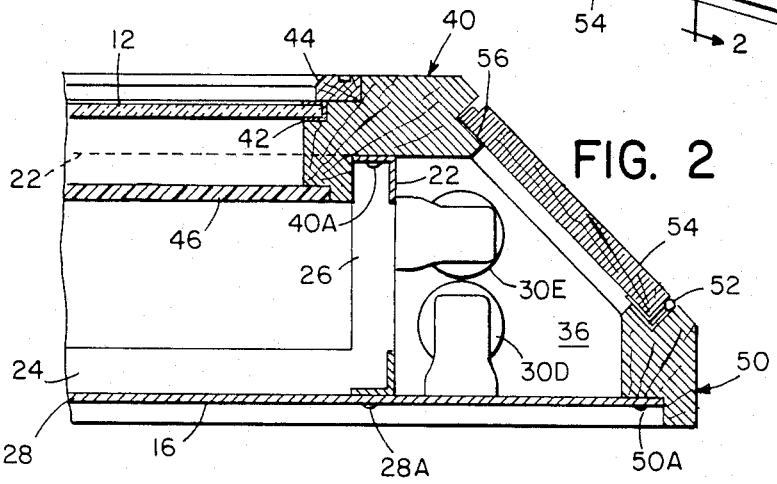
FIG. 2 is a sectional view taken along the line 2—2 of FIG. 1.
Figure 3:
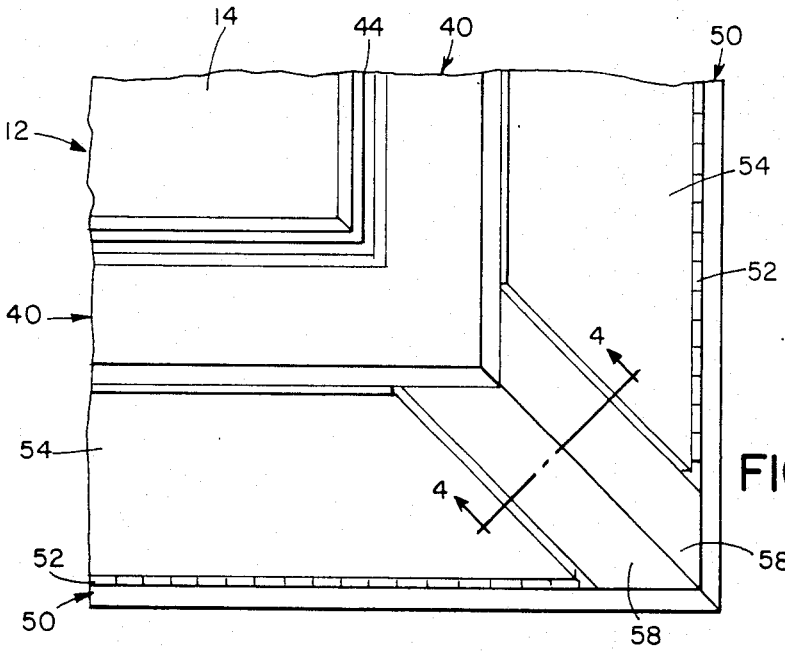
FIG. 3 is an enlarged view of a corner portion of the display frame of FIG. 1.

Further details of the display frame of FIG. 1 may be seen with reference to FIGS. 2 and 3. The display frame 10 includes a structural steel framework 20 of steel angle members 22 that define an outer perimeter frame, a similar inner frame defined by steel angle members 24 and connecting steel angle members 26 at the corners of the inner and outer perimeter frames. Mounted on framework 20 are a series of fluorescent light units 30, there being a single light unit 30A at each end of the framework in the embodiment shown in FIG. 1, a set of two light units 30B, 30C mounted on the framework along the upper side and a second set of light units 30D, 30E along the lower side. A Marlite TM reflector panel 28 is secured to the lower frame by fasteners 28A as indicated in FIG. 2.

Secured to the steel outer perimeter frame 22 by fasteners 40A is a first perimeter assembly 40 of wood that includes a recess 42 in which the stained glass art work 12 is secured with insert members 44. A translucent diffuser panel 46 is secured at the rear of perimeter assembly 40 and extends across the entire sight area between the reflector panel 28 and the stained glass work of art 12.

Figure 4:
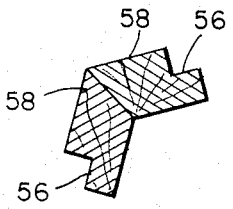
FIG. 4 is a sectional view taken along the line 4—4 of FIG. 3.

Secured to the perimeter of diffuser panel 28 by fasteners 50A is a second perimeter assembly 50 of wood on which are mounted piano-type hinges 52 to which opaque access panels 54 (also of wood) are secured. Each access panel 54 is movable between a locked position in which edges of the panel 54 are seated in a recess 56 in the first perimeter assembly 40 and an open position (partially indicated in FIG. 1) which provides access to the radiation sources secured housed in the compartments defined between the first and second perimeter assemblies. Diagonal corner members 58 extend between the first and second perimeter assemblies and include side boundary recesses 64 (as indicated in FIG. 4) against which the access panels 54 seat in closed position. Controls 62 in the end section of the second perimeter assembly permit selection of different light levels by selecting groups of fluorescent lamps 30 to be energized.

This display frame assembly provides a sturdy support and display structure that enables light-transmitting works of art to be installed on interior walls in a sturdy, protective metal frame structure and aesthetically attractive perimeter frames between which a plurality of light sources are housed together with controls that enable selection of a range of light intensity levels with substantially uniform lighting being transmitted through the diffuser panel and the glass or other light-transmitting art work. A variety of such works of art such as stained glass, etched glass, and hand painted glass may be supported in the protective support and mounting frame assembly, and such frame assembly permits mounting and display of such works of art in locations heretofore unavailable.

While a particular embodiment of the invention has been shown and described, various modifications will be apparent to those skilled in the art, and therefore it is not intended that the invention be limited to the disclosed embodiment, or to details thereof, and departures may be made therefrom within the spirit and scope of the invention.

What is claimed is:

1. Frame structure for support and display of a stained glass work of art or the like comprising a rectangular metal structural frame assembly that defines a sight area for a planar, light-transmitting work of art;

said rectangular metal structural frame assembly including a first metal perimeter frame, a second metal perimeter frame, and a series of sidewall structures interconnecting said first and second perimeter frames that define substantial open sidewalls;

an opaque reflector panel secured to said second metal perimeter frame and disposed at the rear of said structural metal frame assembly and extending over the entire area of said frame assembly;

a perimeter assembly secured to the said first metal perimeter frame, said perimeter assembly including means for securing the work of art within said sight area and defining a series of perimeter compartments that extend about the periphery of said metal frame assembly, one perimeter compartment on each side of said rectangular metal frame assembly;

a diffuser panel extending beneath said sight area between the work of art and said reflector panel and extending over the entire area of said frame assembly parallel to said reflector panel;

a plurality of elongated radiation sources, at least one radiation source disposed in each said perimeter compartment, said radiation sources being located so that radiation from said radiation sources passes through said open sidewall structures of said frame assembly and is reflected by said reflector panel and passes through said diffuser panel and the work of art; and a series of opaque access panels extending around the periphery of said metal frame assembly, each said access panel closing a corresponding one of said perimeter compartments and providing access to a radiation source in said corresponding perimeter compartment.

2. The frame structure of claim 1, wherein each said access panel is of trapezoidal configuration and extends along the length of a side of said frame.

3. The frame structure of claim 2 wherein each said access panel is secured to the second perimeter frame assembly by a piano-type hinge.

4. The frame structure of claim 1 and further including control means for varying the level of radiation from said radiation sources, said control means including a plurality of electrical switch control elements connected to said radiation sources.

5. The frame structure of claim 1 wherein said radiation sources are fluorescent lamp units.

6. The frame structure of claim 1 wherein said metal structural frame assembly includes a plurality of angle members disposed in spaced apart relation to define said substantially open compartment walls adjacent the space between said diffuser and reflector panels.

7. The frame structure of claim 6 wherein each said perimeter assembly is of wood material.

8. The frame structure of claim 7 and further including control means for varying the level of radiation from said radiation sources, said control means including a plurality of electrical switch control elements connected to said radiation sources.

9. The frame structure of claim 7 wherein said radiation sources are fluorescent lamp units.

10. The frame structure of claim 1 and further including control means disposed in said perimeter assembly for varying the level of radiation from said radiation sources.

11. The frame structure of claim 1 wherein said perimeter assembly includes first perimeter structure secured to the forward portion of said metal frame assembly, and second perimeter structure disposed outwardly and rearwardly of said first perimeter structure such that said series of compartments are defined between said first and second perimeter structures.

12. The frame structure of claim 11 wherein said metal structural frame assembly includes a plurality of angle members disposed in spaced apart relation to define substantially open compartment walls adjacent the space between said diffuser and reflector panels.

13. The frame structure of claim 12 wherein each said access panel is of trapezoidal configuration and extends along the length of a side of said rectangular frame.

14. The frame structure of claim 13 wherein each said perimeter structure is of wood material.

* * * * *